United States Patent [19]

Husmann et al.

[11] Patent Number: 4,703,313

[45] Date of Patent: Oct. 27, 1987

[54] PICKET BARRIER AND INTRUSION SENSING SYSTEM

[75] Inventors: Robert J. Husmann, Soquel; Lawrence R. Healy, Jr., Los Altos Hills, both of Calif.

[73] Assignee: Omni Signal, Inc., Capitola, Calif.

[21] Appl. No.: 767,174

[22] Filed: Aug. 19, 1985

[51] Int. Cl.[4] ..... G08B 13/00

[52] U.S. Cl. ..... 340/550; 340/668

[58] Field of Search ..... 340/550, 541, 564, 506, 340/666, 668; 256/8, 10

[56] References Cited

U.S. PATENT DOCUMENTS

| | | | |
|---|---|---|---|
| 4,500,873 | 2/1985 | Porat et al. | 340/668 X |
| 4,503,423 | 3/1985 | Mainiero et al. | 256/8 X |
| 4,558,308 | 12/1985 | Ciordinik et al. | 340/550 |

FOREIGN PATENT DOCUMENTS

| | | | |
|---|---|---|---|
| 373044 | 4/1923 | Fed. Rep. of Germany | 340/550 |
| 1114413 | 9/1961 | Fed. Rep. of Germany | 340/550 |
| 2856819 | 7/1980 | Fed. Rep. of Germany | 340/550 |
| 2925624 | 1/1981 | Fed. Rep. of Germany | 340/550 |
| 415355 | 9/1910 | France | 340/550 |
| 413056 | 7/1934 | United Kingdom | 340/550 |
| 2039683 | 8/1980 | United Kingdom | 340/550 |

*Primary Examiner*—Glen R. Swann, III
*Assistant Examiner*—Thomas J. Mullen, Jr.
*Attorney, Agent, or Firm*—Claude A. S. Hamrick

[57] ABSTRACT

A picket barrier and intrusion sensing system including a plurality of vertically oriented, hollow, picket elements, connected together by means of a horizontal rail that also serves as a communication conduit. Each picket element has disposed therein a picket deformation sensor which is communicatively coupled to a supervised conductive loop contained within the connecting rail conduit. In the event that one or more of the pickets is deformed more than a predetermined amount, the internally contained sensor causes a signal to be generated, transmitted to the supervised loop and in turn sensed by an associated alarm system.

10 Claims, 6 Drawing Figures

PICKET BARRIER AND INTRUSION SENSING SYSTEM

BACKGROUND OF THE INVENTION

1. Field of the Invention

The present invention generally relates to barrier and intrusion detection systems and more particularly, to a novel picket barrier fence system having internally contained intrusion sensing detector devices.

2. Description of the Prior Art

Existing technology in perimeter security systems typically includes the use of various types of fences in combination with barbed obstacles and various types of alarm systems. Such alarm systems utilize electronic sensors to augment the fence barrier and create an alarm if the perimeter is breached. In general, the more sophisticated perimeter systems currently in use combine an aggregate of the above devices, e.g. fence, barbed obstacle and electronic sensor, in order to provide first, a notice of the attempted intrusion, then a delay of the actual intrusion. Little technology exists to combine such devices in what is considered to be an optimal manner. The result is that the physical barrier often diminishes the effectiveness of the sensor or vice versa.

Prior art attempts to solve the problem are disclosed in U.S. Pat. Nos. 4,097,025 to Dettmann et al; 4,155,083 to Slaats et al.; and 4,197,529 to Ramstedt et al. In the Detmann et al. patent, vibration sensors are connected to a fence so as to generate signals for input to an alarm system in the event that one attempts to violate the fence and in so doing causes vibration that can be sensed. Slaats discloses a fence made of wire elements comprised of coaxial conductive layers separated by a thin insulated layer. Intruder pressure applied to the fence generates a contact resistance between the conductive layers or a change in capacitance between that layers that results in a measurable event which upon detection causes an alarm system to be actuated.

A time domain reflectometer is utilized by Ramstedt et al. in combination with an external conductive sheath and an internal conductor separated by a layer of insulating material such that any deformation of the sheath relative to the central conductor generates a variation in the impedance of the cable which can be detected and used to actuate an alarm.

Each of the above prior art approaches are subject to the disadvantages of either requiring aesthetically unpleasing fence structures or apparatus which can be easily violated by knowledgeable and patient intruders.

SUMMARY OF THE PRESENT INVENTION

It is therefore a principal object of the present invention to provide a novel barrier and intrusion detection system which is aesthetically pleasing, difficult to penetrate and intrusion sensitive.

Another object of the present invention is to provide a novel intrusion barrier having a plurality of vertically parallel disposed pickets each of which includes a picket deformation and severing sensor that is communicatively coupled to a suitable supervised conductive loop, or the like, which is in turn connected to a state-of-the-art monitoring and alarm communication device.

Briefly, a preferred embodiment of the present invention includes a plurality of vertically oriented, hollow, picket elements, connected together by means of a horizontal rail that also serves as a communication conduit. Each picket element has disposed therein a picket deformation sensor which is communicatively coupled to a supervised conductive loop contained within the connecting rail conduit. In the event that one or more of the pickets is deformed more than a pre-determined amount, the internally contained sensor causes a signal to be generated, transmitted to the supervised loop and in turn sensed by an associated alarm system.

A principal advantage of the present invention is that it provides a high degree of security without requiring aesthetically obtrusive structures.

Another advantage of the present invention is that it provides effective detection of barrier violation, while at the same time delaying entrance of the potential intruder.

Still another advantage of the present invention is that it provides a modular system which may be implemented in several variant forms and can be simply and efficiently installed and maintained.

These and other advantages of the present invention will no doubt become apparent to those skilled in the art after having read the following detailed disclosure of a preferred embodiment which is illustrated in the several figures of the drawing.

IN THE DRAWING

FIG. 1 depicts a picket fence in accordance with the present invention;

FIGS. 2*a* and 2*b* depict possible modifications of the pickets shown in FIG. 1;

DETAILED DESCRIPTION OF THE PREFERRED EMBODIMENT

Figure 1:
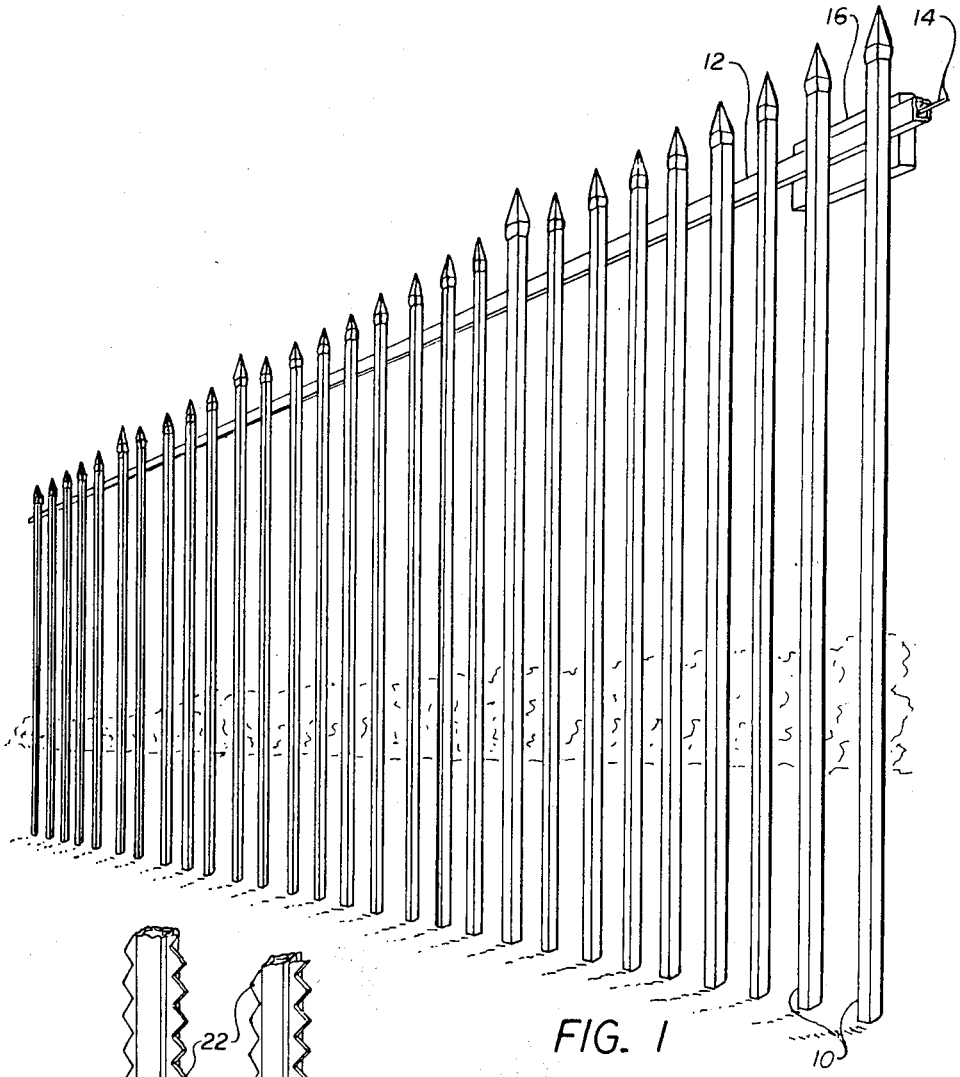

Referring now to FIG. 1 of the drawing, a picket fence and intrusion detection system in accordance with the present invention is shown generally, that includes a plurality of vertical picket elements 10, each of which is generally rectangular in cross section, but alternatively may be octagonal, circular or oval, etc., in cross-section, and extend vertically in parallel relationship to each other. Extending across the upper portion of the pickets is a crossmember or rail 12, which is rectangular in configuration, but may likewise be of other cross-section, and is affixed to each of the pickets to secure them together and prevent relative motion therebetween.

Although the pickets 10, are shown extending into the ground, it is to be understood that alternatively, various ones of the pickets could serve as posts with the remainder of the pickets being suspended above ground and connected to the posts by a second horizontally extending lower rail member similar to that depicted at 12 but positioned a short distance above ground level.

As will be further described hereinbelow, each of the pickets 10 has disposed therein a picket deformation sensor, which is communicatively coupled to a supervised conductive loop shown generally at 14, and extending through the rail 12. Although the loop 14 may be connected in many alternative ways to a suitable alarm system, one possibility is that it be connected to one or more transmitter units such as that illustrated at 16, which transmit to a central receiver to provide localized detection along predetermined segments of the picket barrier fence.

Figure 2A:
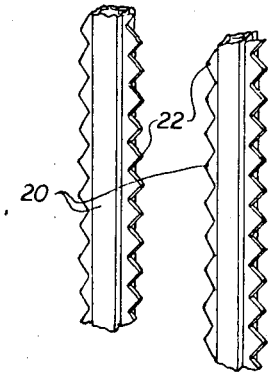

In FIG. 2*a*, a possible modification of the pickets 10 is shown. In this embodiment, each of the pickets 20, are provided with vertically extending ribs 22, which are welded to or otherwise affixed to the sides of each picket and are made saw-toothed in configuration to discourage climbing of the fence. In addition, the tips of the saw-toothed ribs may be bent slightly forward or rearward to more readily catch onto the clothing or flesh of one attempting to violate the barrier.

Figure 2B:
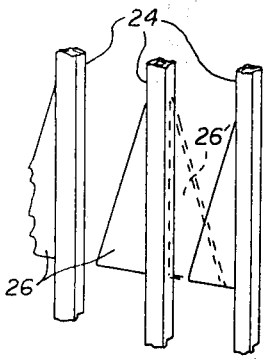

In FIG. 2*b*, another possible modification of the pickets 24 is shown and includes a triangularly shaped member 26 which is attached to each picket midway along its length. Alternatively, two of the members 26 could be attached to opposite sides of every other picket as suggested by the dashed lines 26'. The purpose of the members 26 is to provide limit-stops which restrict the potential deflection of the pickets to only slightly more than that required to actuate an internal sensor element.

It will of course be appreciated that numerous other alternative picket designs could also be used. One design particularly suited to high security application is the "candy cane" configured top.

Figure 3:
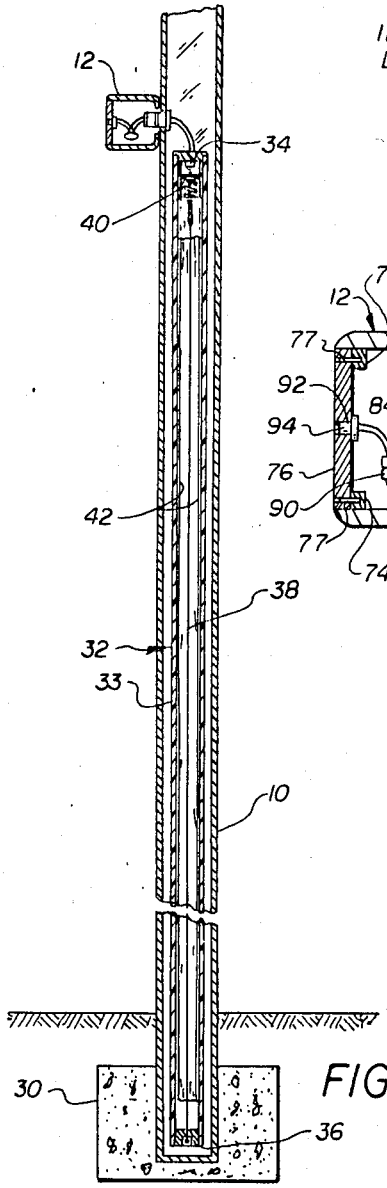
FIG. 3 is a broken partial section illustrating the internal detector components of one of the pickets shown in FIG. 1.
Figure 4:
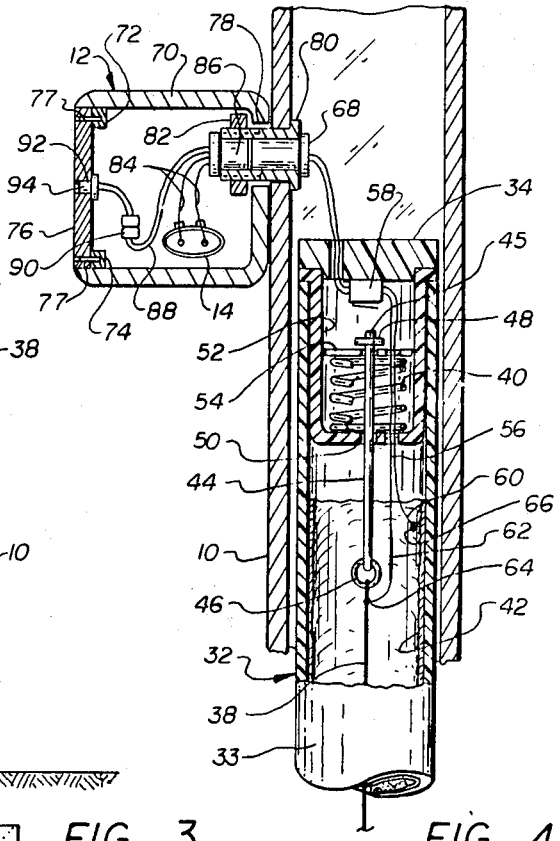
FIG. 4 is an exploded sectional view illustrating a portion of the picket and rail shown in FIG. 3.

Turning now to FIGS. 3 and 4, details of a preferred embodiment of a sensor element contained within each of the pickets will be described. In FIG. 3, a transverse section of one of the pickets is illustrated showing the bottom end of the picket 10 penetrating a concrete or other sub-terranean perimeter footing 30, which provides vertical support for the barrier as well as preventing spreading of the lower extremeties thereof, and depending upon its depth, may also present tunneling beneath the barrier. Disposed within each picket 10, is a sensor element 32, which in the preferred embodiment, is generally tubular in configuration and includes an outer housing 33 and made of a non-conductive material such as PVC pipe, or the like. Both the upper and lower ends of the housing 33 are sealed as indicated at 34 and 36 respectively, and the housing may be changed with a suitable inert gas to prevent condensation and resultant corrosion of the internal components.

Disposed within sensor 32, and extending along substantially its entire length, is a wire-like conductor or rod 38 which extends along the central axis of sensor 32 from the bottom to the top thereof. At the bottom end, it is merely secured to the plug 36, while at the top end it is secured to a spring biasing or other tensioning member 40 which is further depicted in FIG. 4. One of the purposes of the tensioning member 40 is to assure that with changes in temperature, and the resultant variation in elongation of sensor 32 or any part thereof, the wire 38 remains taut and positioned along the axis of the undeformed member 33.

The internal walls of tubular housing 33 are either coated with a conductive material as suggested at 42, or a conductive sleeve or tubular metallic mesh member or the like, of diameter slightly less than the internal diameter of the non-conductive outer tube, is inserted thereto. It will be appreciated that when the picket 10 is in its normal undeformed configuration, the wire 38 will not contact the conductive inner wall 42 and will thus be electrically isolated therefrom. However, it will likewise be evident that should the picket 10 be deformed more than a predetermined amount, the tensioned conductor 38 will contact the conductive inner wall 42, and provide an electrical short therebetween.

Referring now to FIG. 4, details of the upper portion of sensor 32 and rail 12, are shown in more detail. In addition, one possible implementation of interconnection between rail 12 and the pickets 10, together with plugable conductor electrical details is shown.

As illustrated, wire 38 is shown attached to spring 40 by means of a rod 44, having an attachment ring 46 at the bottom end and a threaded nut 48 or similar means at its upper end. Rod 44 passes through an opening 50 in the bottom of a cup-like member 52, through spring 40 and thense through an opening in a spring retainer plate 54. Cup 52 and plate 54 also have additional openings through which a two wire cable 56 extends.

Affixed to the bottom of cap 34 is a microswitch 58 which is adapted to be engaged by the end 45 of rod 44 in the event that wire 38 is severed thereby allowing spring 40 to drive rod 44 upwardly. Switch 58 is connected across the conductors 60, 62 of cable 56 so as to create a short thereacross in the event that it is closed by contact with rod 44. As shown, the lower end of conductor 62 is connected to wire 38 at 64, while the lower end of conductor 60 is connected to the conductive line 42. The upper ends of conductor 60, 62 are connected to the contact members (not shown) of a female plug 68.

Figure 5:
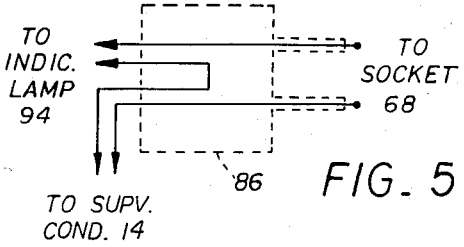
FIG. 5 is a diagram schematically illustrating a feature of the plug shown in FIG. 4.

Rail 12 is depicted as including a channel member 70 which is C-shaped in cross-section and provided with longitudinally extending internal ribs 72 and 74, which provide a means to which elongated closure plate 76 may be attached by means of suitable screws, bolts or the like as illustrated. Rail 12 is provided with a plurality of openings 78, which are adapted to receive a mating lug 80 that is either threaded or welded to each picket member 10. Rail 12 is thus secured to the several pickets by threading a nut 82 onto each lug 80 prior to the installation of closure plate 76. Disposed within rail 12 is a two wire cable 14 which extends therealong and forms a part of the above-mentioned supervised loop. It will be appreciated that cable 14 could likewise form a part of an unsupervised loop detection system. At regular intervals along the cable 12, wires 84 extend to a plug 86 which mates with a socket 68. Extending out of plug 86 is a second pair of wires 88 which is coupled through a connector 90 to an indicator lamp 94 mounted in and visable through an opening 92 formed in plate 76. Lamp 94 is preferably an LED or other suitable low voltage indicator. The purpose of lamp 94 is to indicate the occurance of a short occurring at any point in the electrical circuitry associated with a particular picket, so as to facilitate detection and repair thereof. In order to allow such lamp to be lit only in the event of a short in the sensor 32, plug 86 may be internally configured as indicated in FIG. 5.

From the above, it will be seen that the sensor elements 32 may be prefabricated and that each picket can be preassembled to include a sensor unit 32. Furthermore, the rail 12 can be attached to a number of such pickets on-site by the application of a single nut 82 per picket. The cable 14 along with its interconnected harness sub-assemblies can then be installed and connected to the detectors by means of plugs 86. Subsequently, lamps 94 which are preassembled into plates 76 may be connected to the wiring harnesses by means of the plugs 90, and plate 76 may be installed and locked in place by means of the several bolts or screws 77.

In operation, in the event that any picket fence is deformed enough to cause the wire 38 to contact the conductive inner wall 42, a short will occur across the conductors of cable 14 and be detected by supervisory electronics coupled thereto. Similarly, if any picket 10 were to be severed, the wire 38 of the associated sensor would be likewise severed and spring 40 would drive rod 44 into engagement with microswitch 58 causing a short to likewise occur across cable 14. In either event, the indicator lamp 94 will be energized as a result of the shorted condition.

One advantage of the present invention is that since the sensor elements are hermetically sealed, the fence may be used for underwater applications or in other situations where intrusion detection is difficult to provide.

Although the present invention has been described above in terms of a preferred embodiment, it is contemplated that numerous alterations and modifications of the invention will be apparent to those skilled in the art after having read the above disclosure. It is therefore intended that the following claims be interpreted as covering all such alterations and modifications as fall within the true spirit and scope of the invention.

What is claimed is:

1. A picket barrier and intrusion sensing system, comprising:

a plurality of elongated generally tubular picket elements disposed in spaced apart relationship to form a barrier, each picket element having a straight portion the walls of which form a sensor receiving chamber extending along a substantial part of its length;

connecting rail means connecting said picket elements together and forming a conduit for containing a signal communicative cable means coupled to an alarm system, and sensor means disposed within the sensor receiving chambers of at least some of said picket elements, said sensor means being communicatively coupled to said cable means and operative to detect a predetermined displacement of at least a part of one or more of said picket elements and to communicate a corresponding detection signal to said cable means, said sensor means each including spaced apart electrically conductive electrodes which will be caused to contact each other in the event that said straight portion of the associated picket element is bowed more than a predetermined degree from its rest configuration, each said sensor means being comprised of, an elongated tubular member having a conductive means disposed along at least a portion of its interior walls and forming one of said conductive electrodes, an elongated conductive member forming another of said conductive electrodes disposed along the longitudinal axis of said tubular member, and a pair of electrically conductive wires each having one end thereof connected to one of said conductive electrodes, wherein said contact causes said detection signal to be developed and said sensor means further includes means for detecting the severing of a picket and for likewise causing said detection signal to be developed, said detection signal being thereafter communicated to said alarm system via said cable means.

2. A picket barrier and intrusion sensing system as recited in claim 1 wherein said sensor means further includes closure means disposed at each end of said tubular member to hermetically seal said chamber, and switch means connected across said pair of conductive wires and wherein one end of said conductive member is attached to said tubular member by a spring means associated with said switch means and the other end of said conductive member is connected to a remote end of said tubular member, whereby in the event said conductive member is severed, said spring means will cause said switch means to develop a short circuit across said pair of conductive wires.

3. A picket barrier and intrusion sensing system as recited in claim 1 wherein said rail means is provided with a plurality of indicators which indicate the malfunctioning of any said sensor means.

4. A picket barrier and intrusion sensing system as recited in claim 1 wherein said picket elements are provided with barb forming means for interfering with passage between adjacent ones of said picket elements.

5. A picket barrier and intrusion sensing system as recited in claim 1 wherein at least some of said picket elements are provided with means for limiting the degree of displacement of a part of a particular picket element to slightly more than that required to actuate said sensor means.

6. A picket barrier and intrusion sensing system, comprising:

a plurality of elongated generally tubular picket elements disposed in vertical, spaced apart, parallel relationship to form a barrier, each said picket element having a sensor receiving chamber extending along at least a part of its length;

rail means connecting the upper end portions of said picket elements together and forming a conduit for containing a signal communicative cable means coupled to an alarm system; and sensor means disposed within the sensor receiving chambers of at least some of said picket elements, said sensor means being communicatively coupled to said cable means and operative to detect a predetermined displacement of at least a part of one or more of said picket elements and to communicate a corresponding detection signal to said cable means; each said sensor means being comprised of, an elongated tubular member having a conductive means disposed along at least a portion of its interior walls an elongated conductive member disposed along the longitudinal axis of said tubular member, and a pair of electrically conductive wires each having one end thereof connected to one of said conductive means or said conductive member and extending out of said tubular member, said detection signal being thereafter communicated to said alarm system via said cable means.

7. A picket barrier and intrusion sensing system as recited in claim 6 wherein said sensor means each include spaced apart electrically conductive electrodes which will be caused to contact each other in the event that a picket element is deformed more than a predetermined degree from its rest configuration, said contact causing said detection signal to be developed.

8. A picket barrier and intrusion sensing system as recited in claim 6 wherein said sensor means is also operative to detect the severing of a picket and to likewise cause said detection signal to be developed.

9. A picket barrier and intrusion sensing system as recited in claim 6 wherein said sensor means further includes closure means disposed at each end of said tubular member to hermetically seal said chamber, and switch means connected across said pair of conductive wires, and wherein one end of said conductive member is attached to said tubular member by a spring means associated with said switch means and the other end of said conductive member is connected to a remote end of said tubular member, whereby in the event said conductive member is severed, said spring means will cause said switch means to develop a short circuit across said pair of conductive wires.

10. A picket deformation sensor for insertion into the elongated chamber formed by the walls of a generally tubular picket element forming a component of a picket fence, comprising:

an elongated tubular member having a first conductive means disposed internally thereof at a predetermined position along the length thereof and forming a first electrode;

an elongated second conductive means disposed internally of said tubular member and extending along at least a substantial portion of the length of said tubular member to form a second electrode; and means for connecting each of said conductive electrodes to an alarm system;

closure means disposed at each end of said tubular member to form an hermetically sealed enclosure containing said first and second electrodes;

switch means connected to said electrodes; and resilient means attaching one end of said second conductive means to said switch means, the other end of said second conductive means being connected to a remote end of said tubular member, whereby in the event said second conductive means is severed, said resilient means will cause said switch means to develop a short circuit across said electrodes;

whereby deformation of the sensor containing picket element exceeding predetermined limits causes one of said electrodes to contact the other and cause the development of a responsive electrical signal for communication to said alarm system.

* * * * *